US010940381B1

(12) United States Patent
Huether

(10) Patent No.: US 10,940,381 B1
(45) Date of Patent: Mar. 9, 2021

(54) GOLF SWING TRAINING SYSTEMS

(71) Applicant: Timothy John Huether, Town and Country, MO (US)

(72) Inventor: Timothy John Huether, Town and Country, MO (US)

( * ) Notice: Subject to any disclaimer, the term of this patent is extended or adjusted under 35 U.S.C. 154(b) by 0 days.

(21) Appl. No.: 16/580,472

(22) Filed: Sep. 24, 2019

(51) Int. Cl.
*A63B 69/36* (2006.01)

(52) U.S. Cl.
CPC ..... *A63B 69/3614* (2013.01); *A63B 69/3623* (2013.01); *A63B 2220/805* (2013.01)

(58) Field of Classification Search
CPC ..... A63B 69/3614; A63B 69/3623; A63B 69/222; A63B 69/805
See application file for complete search history.

(56) References Cited

U.S. PATENT DOCUMENTS 3,682,064 A * 8/1972 Matsunaga ..... G03B 35/00 396/325
3,703,135 A * 11/1972 Lang ..... G03B 15/003 396/335
3,820,130 A * 6/1974 Cornelison, Jr. ..... G03B 29/00 396/263
3,820,133 A * 6/1974 Adorney ..... A63B 69/36 396/1
3,918,073 A * 11/1975 Henderson ..... A63B 24/0003 396/335
4,063,259 A * 12/1977 Lynch ..... A63B 24/0021 396/335
4,137,566 A * 1/1979 Haas ..... A63B 24/0003 273/DIG. 24
4,304,406 A * 12/1981 Cromarty ..... A63B 69/36 473/225
5,692,965 A 12/1997 Nighan, Jr. et al.
7,150,683 B2 12/2006 Bender
7,837,572 B2 * 11/2010 Bissonnette ..... A63B 69/3623 473/151
7,959,517 B2 * 6/2011 Lastowka ..... A63B 69/3658 473/198

(Continued)

FOREIGN PATENT DOCUMENTS

CN 204319683 U 5/2015
CN 104548530 B 7/2017

(Continued)

OTHER PUBLICATIONS

Gadget Review: Laser Putt, Dave Wolfe, Oct. 22, 2013, 53 pages.

*Primary Examiner* — Okmar A Deodhar
*Assistant Examiner* — Matthew D Hoel
(74) *Attorney, Agent, or Firm* — Harness, Dickey & Pierce, P.L.C.

(57) ABSTRACT

A golf swing training system includes light source(s) configured to emit light beam(s), one or more sensors configured to sense the emitted light beam(s) from the light source(s), one or more feedback indicators configured to indicate the path of the golf club and/or an angle of a club face of the golf club, and a control circuit in communication with the one or more feedback indicators and the one or more sensors. The control circuit is configured to receive one or more signals from at least one of the sensors, and in response to receiving the one or more signals, turn on at least one of the feedback indicators to output the audible sound or light to indicate the path of the golf club and/or the angle of the club face of the golf club.

20 Claims, 10 Drawing Sheets

(56) References Cited

U.S. PATENT DOCUMENTS

| | | | | |
|---|---|---|---|---|
| 8,137,210 | B2 * | 3/2012 | Gobush | G01P 3/38 473/353 |
| 8,177,654 | B2 | 5/2012 | Pelz | |
| 8,439,767 | B2 | 5/2013 | Feiner | |
| 8,475,289 | B2 * | 7/2013 | Bissonnette | A63B 71/06 473/151 |
| 8,500,568 | B2 * | 8/2013 | Bissonnette | A63B 24/0003 473/151 |
| 8,556,267 | B2 * | 10/2013 | Gobush | A63B 24/0003 273/317.2 |
| 8,622,845 | B2 * | 1/2014 | Bissonnette | A63B 24/0003 473/199 |
| 8,872,914 | B2 * | 10/2014 | Gobush | H04N 13/218 348/135 |
| 8,915,792 | B2 | 12/2014 | Coucher et al. | |
| 8,956,237 | B2 | 2/2015 | Campitelli | |
| 2013/0143684 | A1 | 6/2013 | Painter | |
| 2016/0287966 | A1 | 10/2016 | Fritz et al. | |

FOREIGN PATENT DOCUMENTS

| | | | |
|---|---|---|---|
| KR | 20160028689 | A | 3/2016 |
| KR | 101695205 | B1 | 1/2017 |
| WO | WO-2010117192 | A2 | 10/2010 |

* cited by examiner

GOLF SWING TRAINING SYSTEMS

FIELD

The present disclosure relates to golf swing training systems.

BACKGROUND

This section provides background information related to the present disclosure which is not necessarily prior art.

Golf swing training devices are used to provide feedback to golfers. The devices may include one or more lasers attached to golf clubs that emit laser beams to allow golfers to observe the path of the clubs. In some cases, a photo-reactive surface is employed to create a temporary visual representation of the path of the laser beams over the surface.

SUMMARY

This section provides a general summary of the disclosure, and is not a comprehensive disclosure of its full scope or all of its features.

According to one aspect of the present disclosure, a golf swing training system for tracking a path of a golf club when a golfer swings the golf club is disclosed. The training system includes a support structure positionable to a side of a golfer when the golfer sets up in an address position, a light source configured to attach to the golfer or the golf club, and emit a light beam that follows the path of the golf club when the golfer swings the golf club, a plurality of sensors configured to attach to the support structure in a defined pattern for sensing the emitted light beam from the light source, one or more feedback indicators configured to attach to the support structure for indicating the path of the golf club, and a control circuit in communication with the feedback indicators and the plurality of sensors. Each feedback indicator is associated with at least one of the sensors. The control circuit is configured to receive a signal from a sensor of the plurality of sensors in response to the sensor sensing the emitted light beam from the light source, and in response to receiving the signal, turn on one of the feedback indicators associated with the sensor to indicate the path of the golf club.

According to another aspect of the present disclosure, a golf swing training system for tracking a golf club and/or an angle of a club face of the golf club when a golfer swings the golf club is disclosed. The training system includes a light source configured to attach to the golfer or the golf club, and emit a light beam forming a line segment that follows a path of the golf club when the golfer swings the golf club, two sensors positionable in a defined pattern for sensing the line segment emitted from the light source, a feedback indicator configured to output an audible sound or light, and a control circuit in communication with the feedback indicator and the two sensors. The two sensors are configured to generate a signal in response to the two sensors sensing the line segment emitted from the light source at the same time. The control circuit is configured to receive the signal from the sensors, and turn on the feedback indicator to output the audible sound or light in response to receiving the signal.

According to yet another aspect of the present disclosure, a golf swing training system for tracking a path of a golf club during a golfer's downswing is disclosed. The training system includes a support structure positionable to a side of a golfer when the golfer sets up in an address position, a light source configured to attach to the support structure and emit a light beam, a sensor positionable in a defined location on the ground in a desired path of the golf club, a feedback indicator configured to output an audible sound or light, and a control circuit in communication with the feedback indicator and the sensor. The sensor is configured to sense the light beam emitted from the light source and generate a signal when the light beam emitted from the light source is broken due to the golfer's downswing. The control circuit is configured to receive the signal from the sensor, and turn on the feedback indicator to output the audible sound or light in response to receiving the signal to indicate the golf club is in the desired path during the golfer's downswing.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts and/or features throughout the several views of the drawings.

DETAILED DESCRIPTION

Figure 1A:
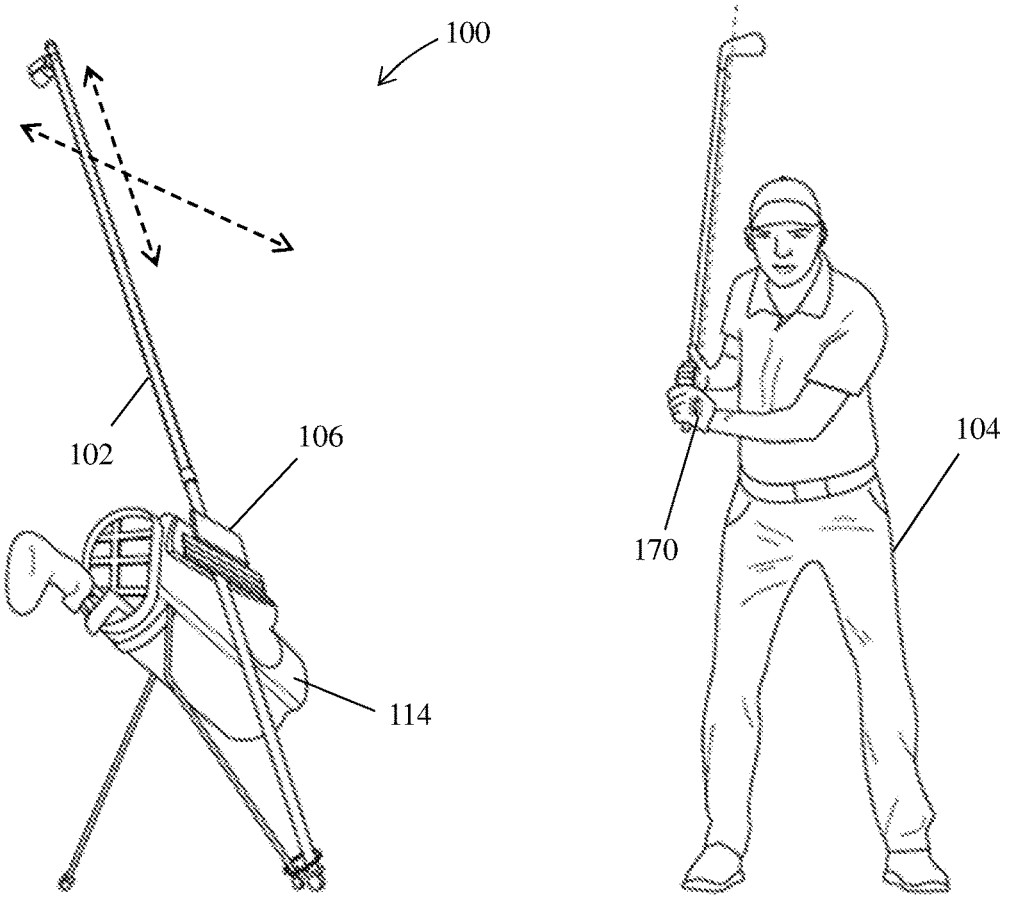
FIGS. 1A and 1B are perceptive views of a golf swing training system including a feedback assembly for tracking a path of a golf club according to one example embodiment of the present disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments will now be described more fully with reference to the accompanying drawings.

Golfers have long desired to have a productive and consistent golf swing for all of their golf clubs including irons, fairway woods, drivers, etc. As recognized by the subject inventor, the golf swing training systems disclosed herein teach golfers a proper and consistent swing for all of their clubs by providing specific feedback such as visual feedback, audible feedback, etc. before and during each part of the golfers' swing (e.g., setup, backswing, downswing, follow through, etc.). Whether they are professionals or amateurs, experienced or inexperienced, etc., golfers may use their own golf clubs and hit golf balls while utilizing the golf swing training systems to improve multiple areas of their swing such as swing planes, club face angles, club head lag, etc.

As further explained below, the golf swing training systems may include one or more adjustable components for tailoring the systems to a particular golfer and his/her golf swing. For example, the swing plane of each club for each golfer may be unique due to varying lengths of the clubs, heights of golfers, etc. In such examples, each swing plane includes the plane extending through the hosel of the golf club at setup, the bottom of the golfer's elbow at setup, and the target. As such, a shorter length iron (e.g., a nine iron) has a naturally steeper swing plane angle referenced to the ground than a longer length iron (e.g., a three iron). Due to the adjustable characteristics of the golf swing training systems, a golfer may produce a productive and consistent swing plane for each of his/her clubs (e.g., a nine iron. a three iron, etc.).

Figure 1B:
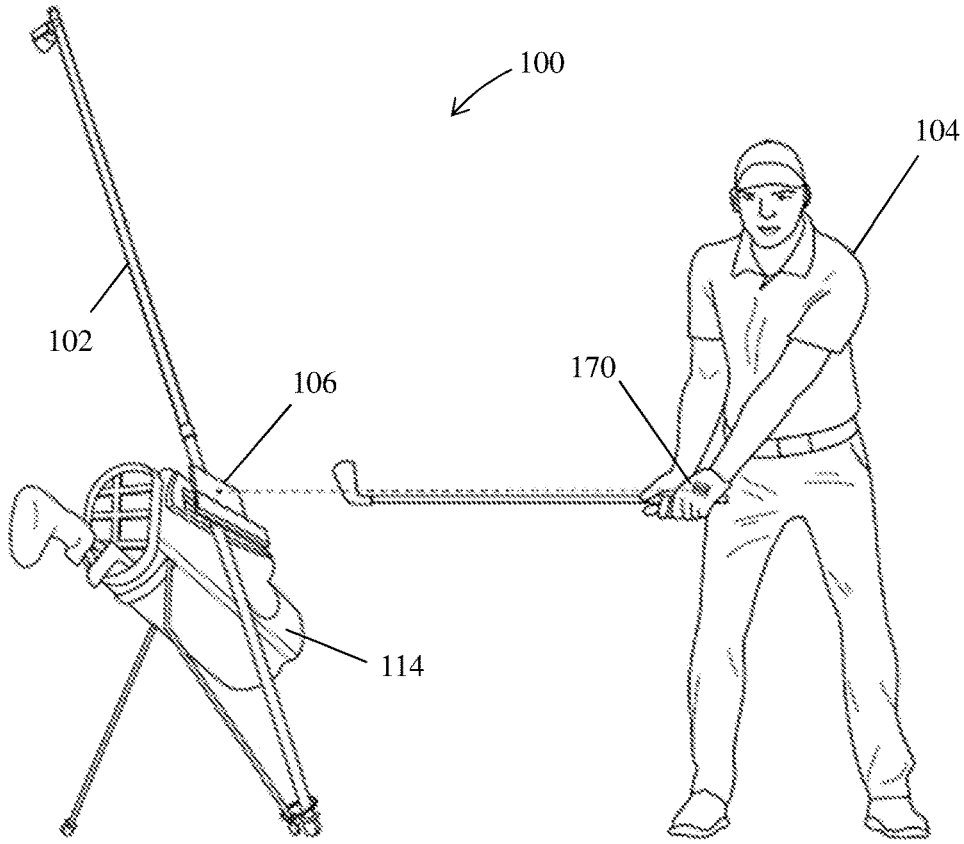

A golf swing training system for tracking a path of a golf club when a golfer swings the golf club according to one example embodiment of the present disclosure is illustrated in FIGS. 1A and 1B, and indicated generally by reference number 100. As shown in FIGS. 1A and 1B, the golf swing training system 100 includes a support structure 102 positioned to a side of a golfer 104 when the golfer 104 sets up in an address position and a feedback assembly 106 attached to the support structure 102.

As shown in FIGS. 1A and 1B, the support structure 102 is an elongated rod extending in a longitudinal direction. In some examples, the rod may extend in one continuous direction. Alternatively, the rod may extend in multiple directions due to one or more curved portions, joints, etc. In other embodiments, the support structure 102 may be another suitable structure such as a pole, a post, a wall, etc.

In some examples, the support structure 102 may be attached to another object. For example, and as shown in FIGS. 1A and 1B, the support structure 102 is attached to a movable golf bag 114. In such examples, the support structure 102 may be attached (e.g., detachably coupled, etc.) to the golf bag 114 via one or more mechanical devices such as magnets, brackets, fasteners, etc. In other examples, the support structure 102 may be attached to another movable or fixed object such as a bench, a chair, a flagpole, a post, etc. Alternatively, the support structure 102 may not be attached to another object. In such examples, the support structure 102 may be free standing, inserted into the ground, etc.

As shown in FIGS. 1A and 1B, a light source 170 may attach to the golfer 104, and emit a light beam that follows the path of the golf club when the golfer swings the golf club. In the particular example of FIGS. 1A and 1B, the light source 170 is detachably coupled to the golfer's glove, and is pointed near the hosel of the club. In some examples, the light source 170 may include a laser capable of emitting a laser beam forming a single dot (e.g., as shown in FIG. 1B), a line segment, etc. as further explained below. In other examples, the light source 170 may be attached to the club.

Figure 2:
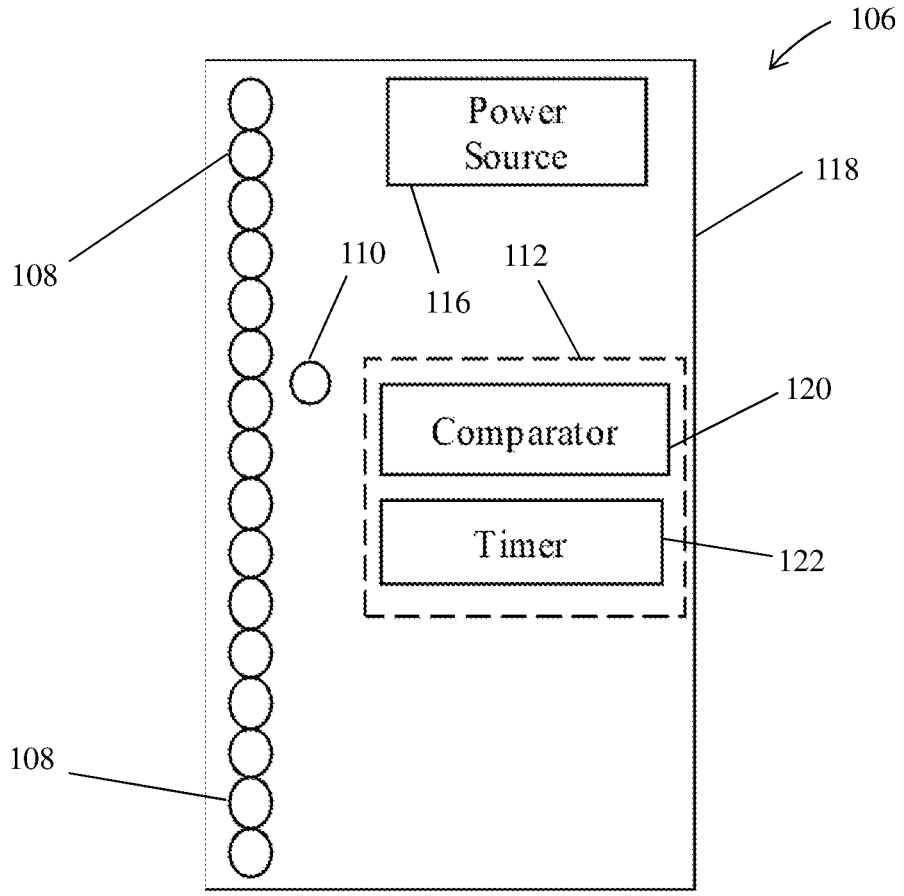
FIG. 2 is a block diagram of a feedback assembly employable in the training system of FIGS. 1A and 1B, according to another example embodiment.

As shown in FIG. 2, the feedback assembly 106 includes sensors 108, a feedback indicator 110 and a control circuit 112. The sensors 108 are arranged in a defined pattern for sensing emitted light beam from the light source 170, and the feedback indicator 110 indicates the path of the golf club. The defined pattern may include a linear arrangement in which the sensors 108 are adjacent each other, in contact with each other, etc. In other examples, the defined pattern may include one or more curved arrangements.

The control circuit 112 is in communication with the feedback indicator 110 and the sensors 108. For example, and as further explained below, the control circuit 112 receives a signal from at least one of the sensors 108 in response to that sensor sensing the emitted light beam from the light source 170 (e.g., attached to the golfer 104, the golf club, etc.). In response to receiving the signal, the control circuit 112 turns on the feedback indicator 110. This indicates to the golfer 104 that his/her club passed over one of the sensors 108, and provides feedback as to the path of the golf club.

Additionally, the feedback assembly 106 of FIG. 2 may include a power source 116 for powering the feedback indicator 110 and the control circuit 112. In some examples, the power source 116 may be an onboard power source such as one or more batteries (e.g., rechargeable batteries, etc.). In other examples, the power source 116 may include a wired connection to an external source.

Components of the feedback assembly 106 and/or any other feedback assembly disclosed herein may be grouped together in a single module or separated from each other. For example, the sensors 108, the feedback indicator 110, the control circuit 112 and the power source 116 of FIG. 2 may be electrically and physically coupled (e.g., soldered, etc.) to a substrate 118 such as a circuit board (e.g., a printed circuit board). The substrate 118 and/or a casing housing the substrate may be attached to the support structure 102. Alternatively, one or more of the sensors 108, the feedback indicator 110, the control circuit 112 and/or the power source 116 may be physically separated from each other while remaining electrically coupled. In such examples, any one of the sensors 108, the feedback indicator 110, the control circuit 112 and/or the power source 116 may be separately attached to the support structure 102 if desired.

Figure 3:
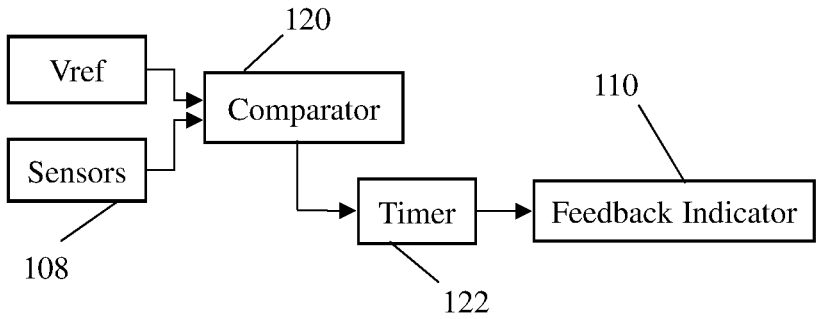
FIG. 3 is a control flow diagram for a control circuit of the feedback assembly of FIG. 2, according to yet another example embodiment.

As shown in FIG. 2, the control circuit 112 may include various components for controlling the feedback indicator 110. In the particular example of FIG. 2, the control circuit 112 includes a comparator 120 and a timer 122. In such examples, the comparator 120 compares a received signal from at least one of the sensors 108 to a reference signal Vref, and outputs a signal based on the comparison to the timer 122, as shown in FIG. 3. For example, the comparator 120 may output the signal (e.g., a voltage signal) when it receives the sensor's signal. As shown in FIG. 3, the timer 122 activates after receiving the comparator's signal, and turns on the feedback indicator 110. For example, the timer 122 may send a control signal to a switching device coupled between the power source 116 and the feedback indicator 110 to activate the feedback indicator 110, pass the voltage signal from the comparator 120 to the feedback indicator 110 to activate the feedback indicator 110, etc.

In some examples, the control circuit 112 may turn off the feedback indicator 110 in response to a defined event. For example, the control circuit 112 may turn off the feedback indicator 110 after a defined period of time. In such examples, the timer 122 may track an elapsed time after it is activated (e.g., after the feedback indicator 110 is turned on). Once the elapsed time reaches a threshold amount, the timer 122 may deactivate (e.g., turn off) the feedback indicator 110. Alternatively, the timer 122 may count down from a defined number after it is activated, and then deactivate the feedback indicator 110 after the timer 122 reaches a defined number (e.g., zero, etc.). In such examples, the timer 122 may turn off the switching device coupled between the power source 116 and the feedback indicator 110, interrupt the voltage signal from the comparator 120 to the feedback indicator 110, etc.

Referring back to FIG. 2, the feedback indicator 110 may be associated with one or more of the sensors 108. In the particular embodiment of FIG. 2, the feedback indicator 110 is associated with sixteen sensors 108. In such examples, the feedback indicator 110 may turn on when any one of the sixteen sensors 108 senses emitted light beam from the light source.

Figure 4:
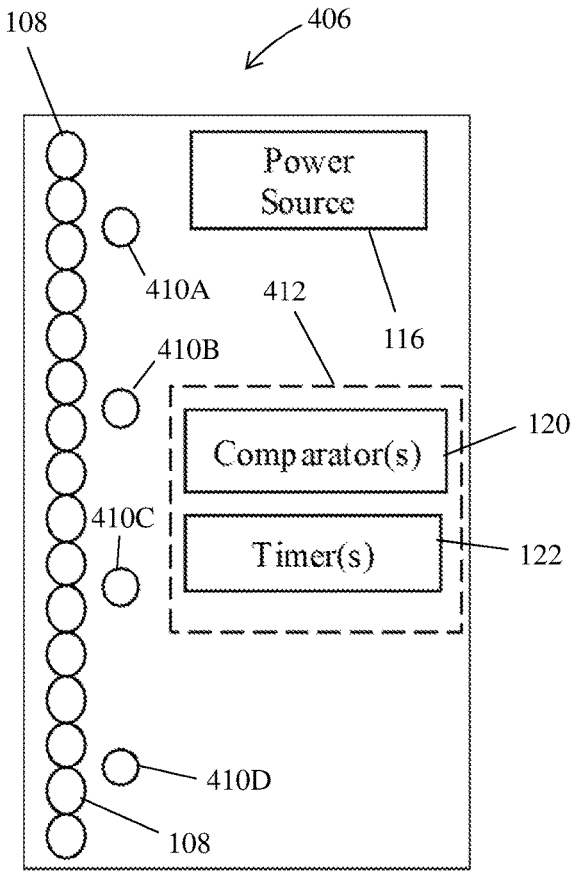
FIGS. 4-5 are block diagrams of feedback assemblies employable in the training system of FIGS. 1A and 1B, according to other example embodiments.

In other embodiments, the feedback indicator 110 may be associated with two sensors, four sensors, six sensors, etc. For example, FIG. 4 illustrates a feedback assembly 406 substantially similar to the feedback assembly 106 of FIG. 2, but including multiple feedback indicators. Specifically, the feedback assembly 406 of FIG. 4 includes the sixteen sensors 108 and the power source 116 of FIG. 2, four feedback indicators 410A, 410B, 410C, 410D each similar to the feedback indicator 110 of FIG. 2, and a control circuit 412 similar to the control circuit 112 of FIG. 2.

In the particular embodiment of FIG. 4, each feedback indicator 410A, 410B, 410C, 410D is associated with its own set of four sensors. Specifically, and as shown in FIG. 4, the feedback indicator 410A is associated with the first four sensors (e.g., a first set of sensors), the feedback indicator 410B is associated with the next four sensors (e.g., a second set of sensors), and so on. In such examples, the feedback indicators 410A, 410B, 410C, 410D may be positioned in a defined pattern for indicating the path of the golf club. For example, and as shown in FIG. 4, the feedback indicator 410A may be positioned adjacent to the first set of sensors, the feedback indicator 410B may be positioned adjacent to the second set of sensors, and so on.

The control circuit 412 of FIG. 4 may receive a signal from at least one sensor of one set of sensors (e.g., the first set of sensors, etc.) when emitted light beam from the light source is sensed. In response to receiving the signal, the control circuit 412 may turn on the corresponding feedback indicator (e.g., the feedback indicator 410A, etc.) thereby notifying the golfer that his/her swing path passed over a particular set of sensors.

As shown in FIG. 4, the control circuit 412 may include multiple comparators 120 and timers 122. In such examples, each feedback indicator and its corresponding set of sensors may be in communication with its own comparator 120 and timer 122 so that each feedback indicator is individually controlled, as explained above relative to FIGS. 2 and 3. For example, the first set of sensors may be associated with one comparator 120 and one timer 122, the second set of sensors may be associated with another comparator 120 and another timer 122, and so on.

As the number of sensors associated with each feedback indicator decreases, the path of the golf club may be tracked with more precision. For example, the first set of sensors associated with the feedback indicator 410A define one detection length, the second set of sensors associated with the feedback indicator 410B define another detection length, and so on. Each of the detection lengths correspond to a different possible swing path. As such, the feedback indicators and sensor arrangement of FIG. 4 equates to four different detectable swing paths. In contrast, the feedback indicator and sensor arrangement of FIG. 2 equates to one detectable swing path. Thus, if the sensors 108 of FIG. 2 and the sensors 108 of FIG. 4 define the same total detection length, the arrangement of FIG. 4 would provide more precision in tracking the path of the golf club as compared to the arrangement of FIG. 2.

Figure 5:
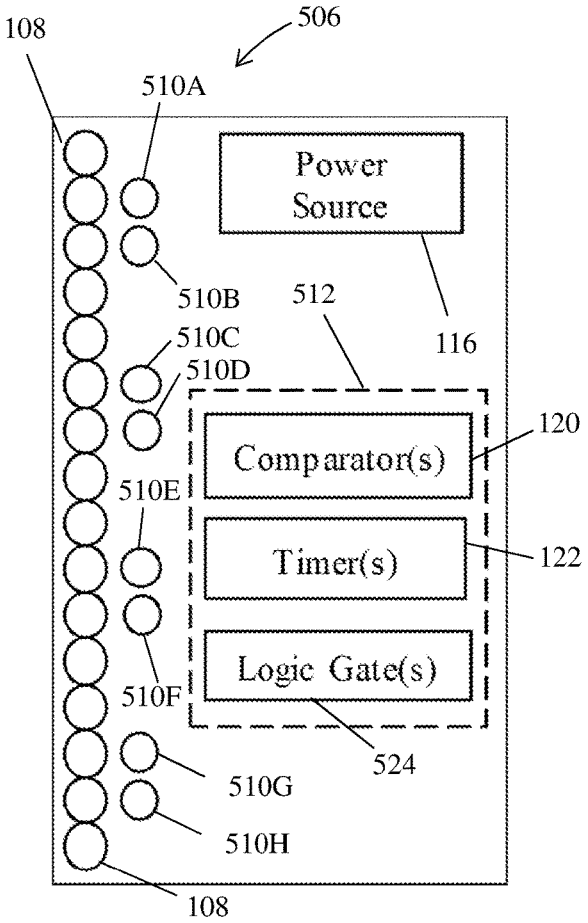

FIG. 5 illustrates a feedback assembly 506 substantially similar to the feedback assembly 406 of FIG. 4, but including additional feedback indicators. Specifically, the feedback assembly 506 of FIG. 5 includes the sixteen sensors 108 and the power source 116 of FIG. 2, eight feedback indicators 510A, 510B, 510C, 510D, 510E, 510F, 510G, 510H each similar to the feedback indicators 410 of FIG. 4, and a control circuit 512 similar to the control circuit 412 of FIG. 4.

In the particular embodiment of FIG. 5, two feedback indicators are associated with its own set of four sensors. Specifically, and as shown in FIG. 5, the feedback indicators 510A, 510B are associated with the first four sensors (e.g., a first set of sensors), the feedback indicators 510C, 510D are associated with the next four sensors (e.g., a second set of sensors), and so on.

In such examples, the control circuit 512 may receive a signal from at least one sensor of one set of sensors (e.g., the first set of sensors, etc.) when emitted light beam from the light source is sensed. In response to receiving the signal, the control circuit 512 may turn on the corresponding feedback indicator (e.g., the feedback indicator 510A, etc.) thereby notifying the golfer that his/her swing path passed over a particular set of sensors during the golfer's backswing. The control circuit 512 may then receive another signal from at least one sensor of one set of sensors (e.g., the first set of sensors, the second set of sensors etc.) when emitted light beam from the light source is sensed. In response to receiving this other signal, the control circuit 512 may turn on the corresponding feedback indicator (e.g., the feedback indicator 510B, the feedback indicator 510C, etc.) thereby notifying the golfer that his/her swing path passed over a particular set of sensors during the golfer's downswing.

As shown in FIG. 5, the control circuit 512 may include multiple comparators 120 and timers 122, and multiple logic gate devices 524. In such examples, each set of two feedback indicators and its corresponding set of sensors may be in communication with its own comparator(s), timer(s) and logic gate device so that each set of feedback indicators is individually controlled, as explained above relative to FIGS. 2 and 3.

Figure 6:
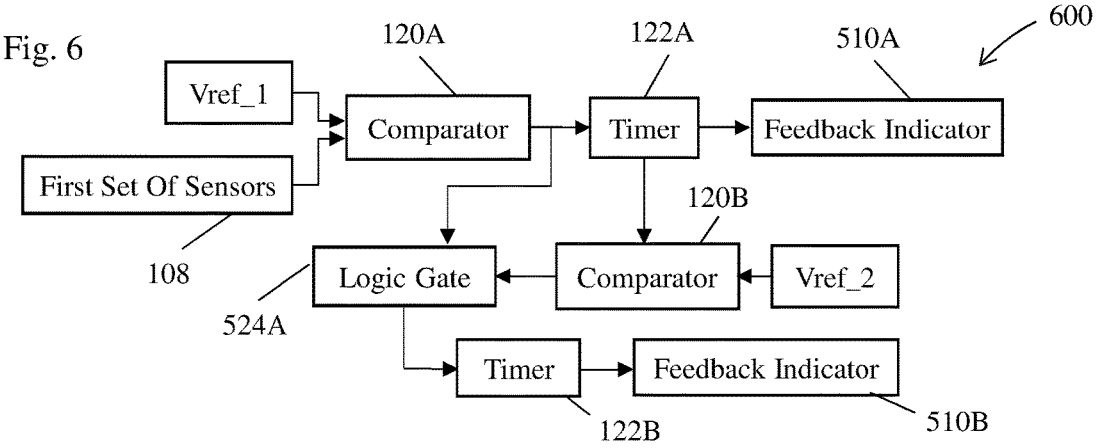
FIG. 6 is a control flow diagram for a control circuit of the feedback assembly of FIG. 5, according to yet another example embodiment.
Figure 7:
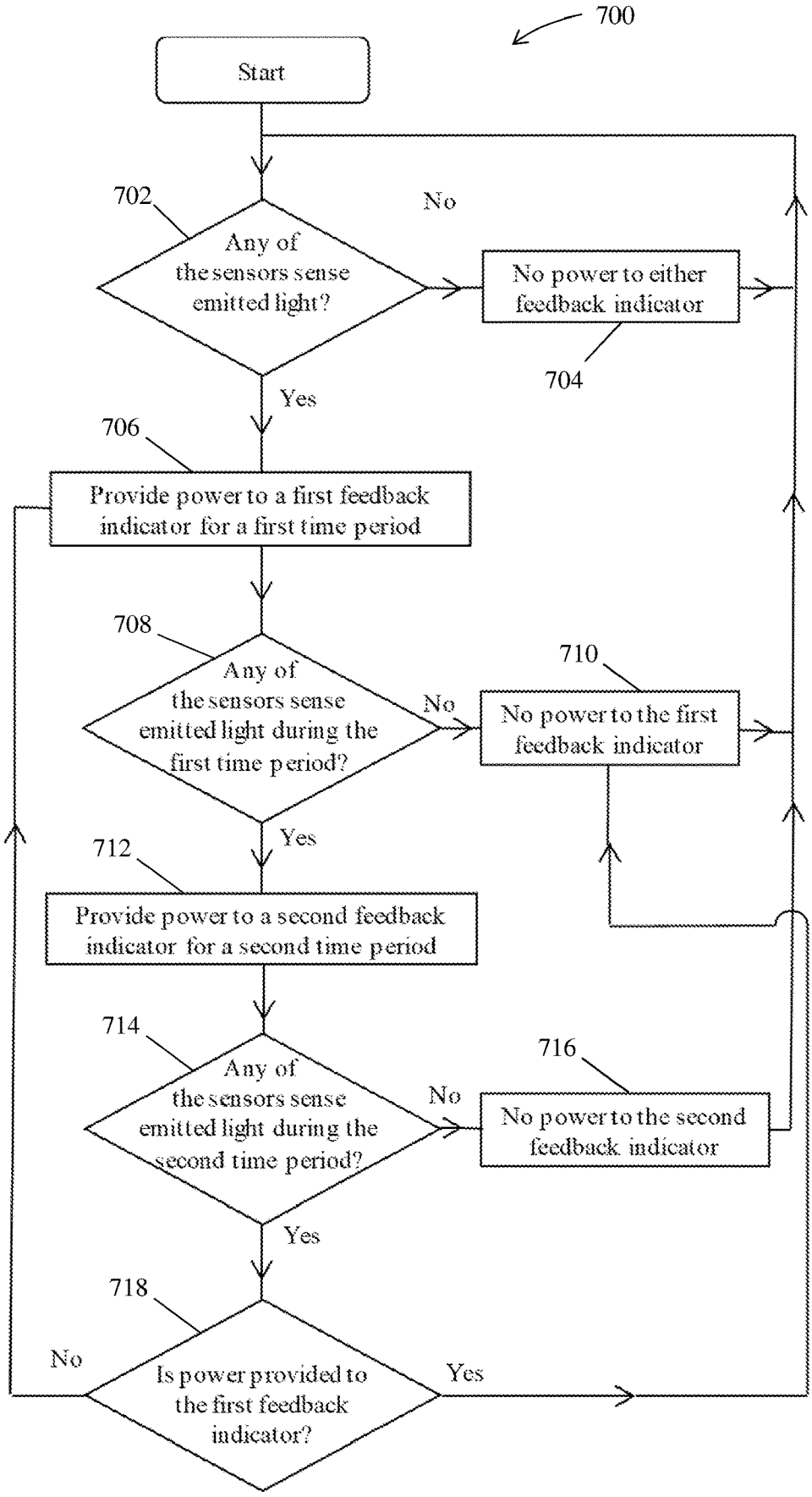
FIG. 7 is a flow diagram for turning on and off feedback indicators of the feedback assembly of FIG. 5, according to another example embodiment.

FIGS. 6 and 7 illustrate an example flow diagram 600 and timing sequence 700, respectively, for the first set of sensors and the feedback indicators 510A, 510B. For example, the control circuit 512 may include two comparators 120A, 120B, two timers 122A, 122B and a logic gate device 524A that communicate with the first set of sensors 108 and the feedback indicators 510A, 510B as shown in FIG. 6.

When one of the sensors of the first set of sensors 108 senses emitted light from the light source in block 702 of FIG. 7, a signal is sent to the comparator 120A of FIG. 6. The comparator 120A compares a received signal from at least one of the sensors 108 to a reference signal Vref_1 and outputs a signal to the timer 122A and the logic gate device 524A, as shown in FIG. 6. Next, the timer 122A is activated for a first defined period of time, and power is provided to turn on the feedback indicator 510A (in block 706) for that defined period of time. If no light is sensed, power is not provided to the feedback indicator 510A (in block 704), and the timing sequence 700 returns to sensing emitted light.

If one of the sensors of the first set of sensors 108 senses another emitted light from the light source in block 708 of FIG. 7, a second signal is sent to the comparator 120A of FIG. 6. The comparator 120A compares the second signal to the reference signal Vref_1 and outputs another signal to the timer 122A. If the first defined period of time has not elapsed (e.g., the timer 122A is still activated), the timer 122A provides a signal to the comparator 120B as shown in FIG. 6. The comparator 120B compares the signal to a reference signal Vref_2 and outputs a signal to the logic gate device 524A. When the logic gate device 524A (e.g., an AND gate) receives the signal from the comparator 120A and the signal from the comparator 120B, the timer 122B of FIG. 6 is activated for a second defined period of time and power is provided to turn on the feedback indicator 510B (in block 712) for that defined period of time. The second defined period of time may be the same or different than the first defined period of time. If no light is sensed during the first period of time, power is not provided to the feedback indicator 510A (in block 710) and the timing sequence 700 returns to sensing emitted light.

If one of the sensors of the first set of sensors 108 senses another emitted light from the light source (block 714) during the second defined period of time, and the first feedback indicator 510A is off (block 718), the timing sequence 700 returns to block 706 to turn on the first feedback indicator 510A. Conversely, if one of the sensors of the first set of sensors 108 senses another emitted light from the light source (block 714) during the second defined period of time, and the first feedback indicator 510A is on (block 718), the timing sequence 700 returns to block 710 to time out and turn off the first feedback indicator 510A. If no light is sensed during the second period of time in block 714, power is not provided to the feedback indicator 510B (in block 716), and the timing sequence 700 returns to sensing emitted light.

Figure 8:
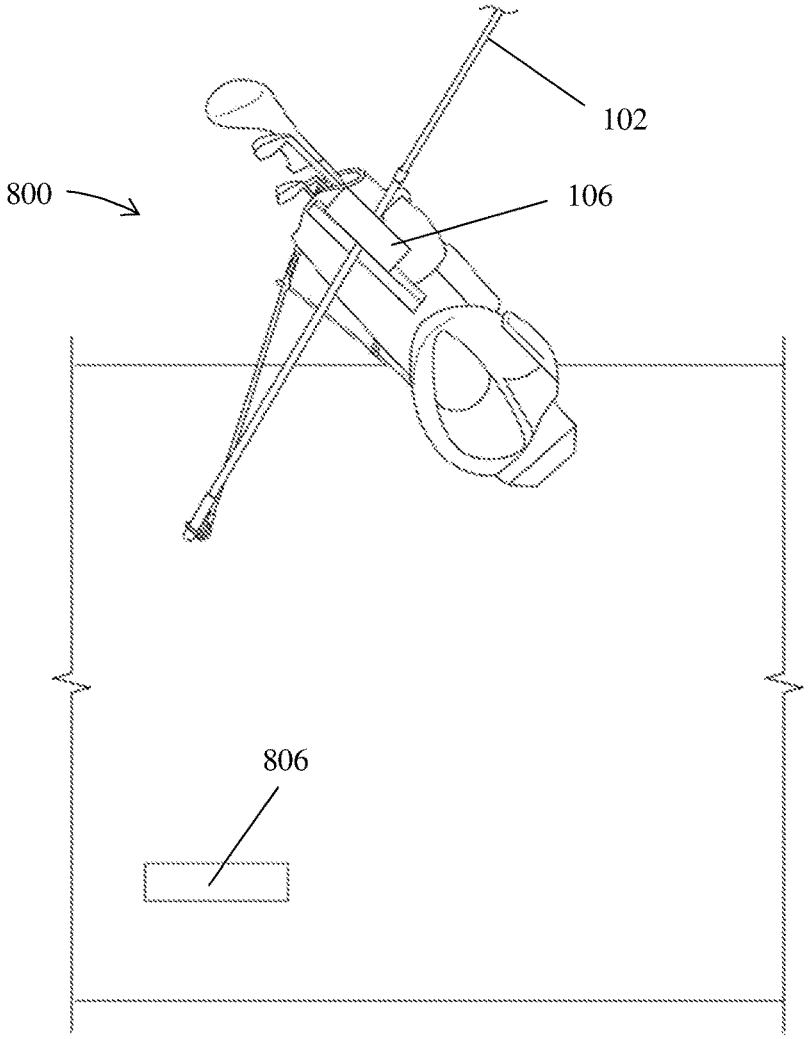
FIG. 8 is a front view of a golf swing training system including multiple feedback assemblies for tracking a path of a golf club according to yet another example embodiment.

FIG. 8 illustrates a golf swing training system 800 similar to the golf swing training system 100 of FIGS. 1A and 1B, but including another feedback assembly 806. For example, the system 800 includes the support structure 102 and the feedback assembly 106 of FIGS. 1A and 1B, and the feedback assembly 806. The feedback assembly 806 of FIG. 8 is substantially similar to the feedback assemblies 106, 406 of FIGS. 1 and 4, but includes a different number of sensors and feedback indicators.

In particular example of FIG. 8, the feedback assembly 806 is positioned on the ground. Specifically, the feedback assembly 806 may be positioned on the ground in front of and to the side the golfer's feet. For example, if the golfer is right-handed, the feedback assembly 806 may be in front of and to the left of the golfer's left foot. In such examples, the feedback assembly 806 may track and provide feedback relating to the golfer's follow through portion of his/her swing. Alternatively, the feedback assembly 806 may be positioned in another suitable location to track another portion of the golfer's swing.

Figure 9:
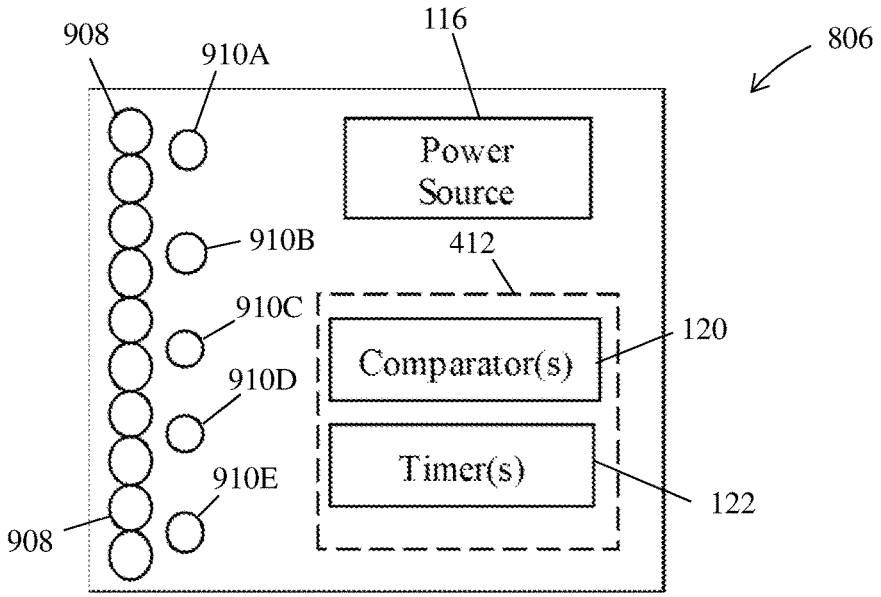
FIG. 9 is a block diagram of a feedback assembly employable in the training system of FIG. 8, according to another example embodiment.

As shown in FIG. 9, the feedback assembly 806 includes the power source 116 of FIGS. 1A and 1B, the control circuit 412 of FIG. 4, ten sensors 908 and five feedback indicators 910A, 910B, 910C, 910D, 910E. The sensors 908 and the feedback indicators 910A, 910B, 910C, 910D, 910E are similar to the other sensors 108 and feedback indicators 110, 410 explained above.

Each feedback indicator 910A, 910B, 910C, 910D, 910E of FIG. 9 is associated with two sensors 908. For example, the feedback indicator 910A is associated with the first two sensors 108 (e.g., a first set of two sensors), the feedback indicator 910B is associated with the next two sensors 108 (e.g., a second set of two sensors), and so on.

In the example of FIGS. 8 and 9, the control circuit 412 includes multiple comparators 120 and timers 122. In such examples, each feedback indicator 910A, 910B, 910C, 910D, 910E and its corresponding set of two sensors 908 may be in communication with its own comparator (e.g., one of the comparators 120) and timer (e.g., one of the timers 122). In this way, each feedback indicator 910A, 910B, 910C, 910D, 910E may be individually controlled, as explained above.

Figure 10A:
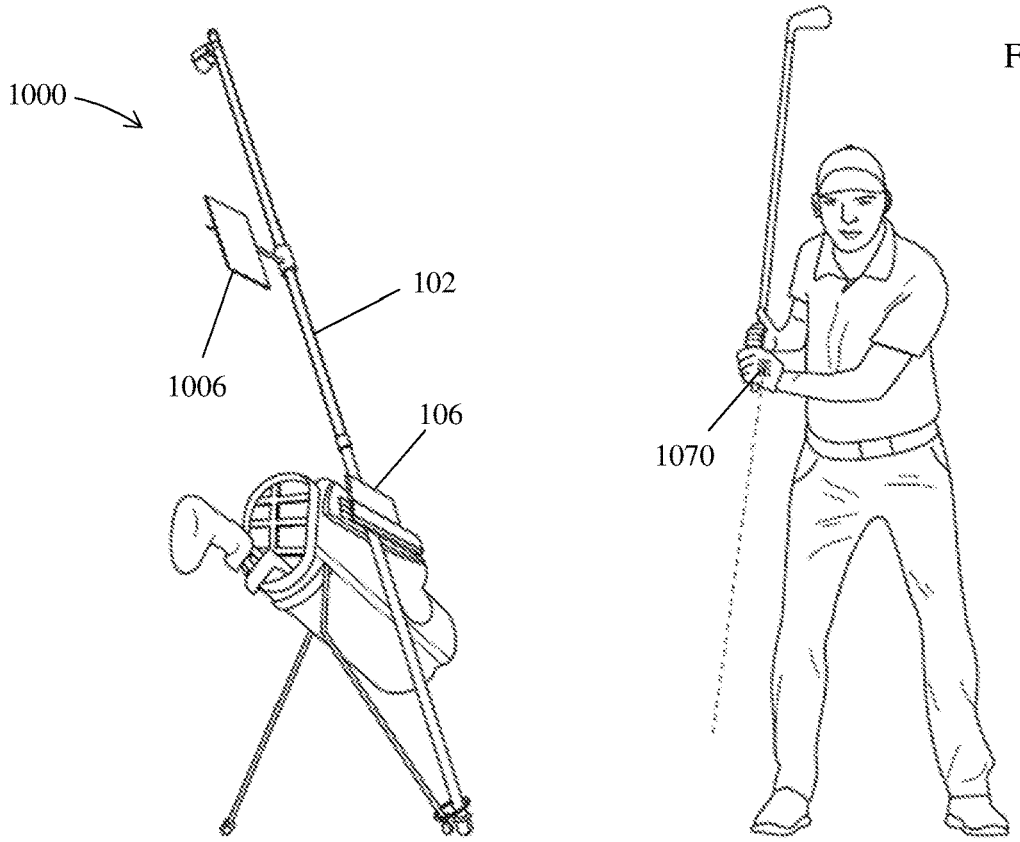
FIGS. 10A and 10B are perceptive views of a golf swing training system including a feedback assembly for tracking a path of a golf club according to yet another example embodiment.
Figure 10B:
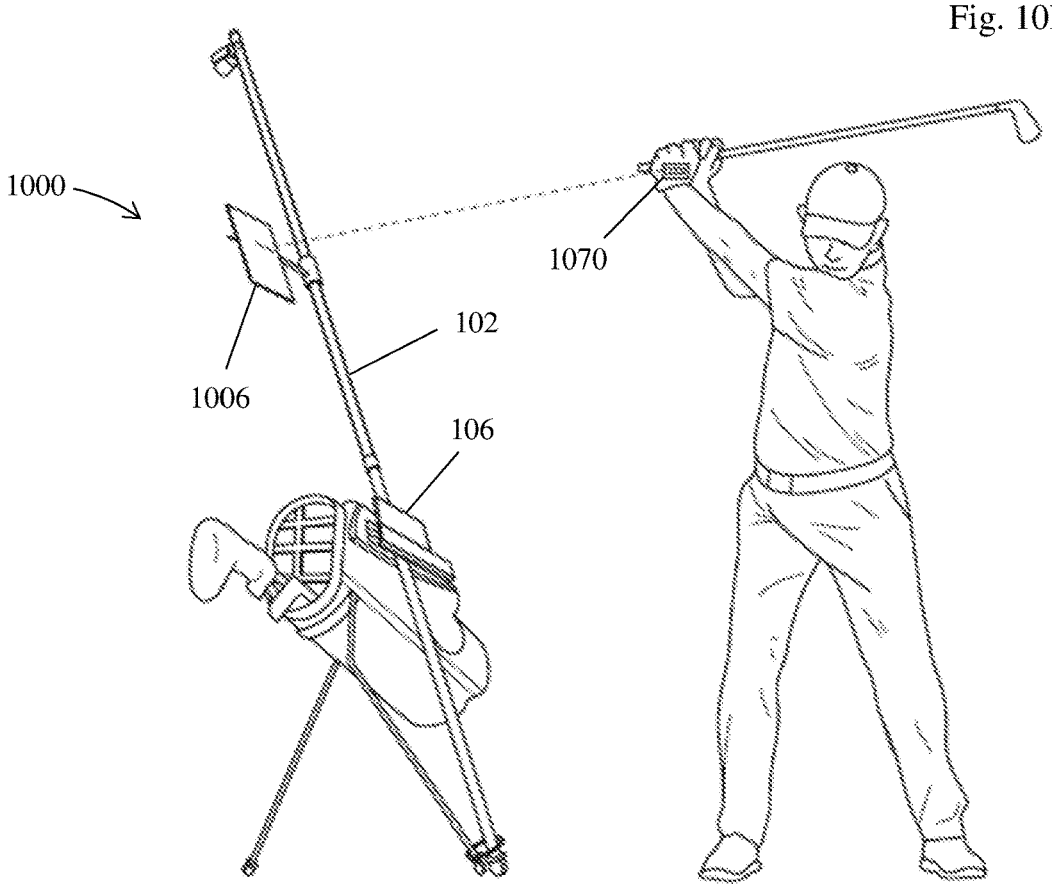

FIGS. 10A and 10B illustrate a golf swing training system 1000 similar to the golf swing training system 100 of FIGS. 1A and 1B, but including another feedback assembly 1006. For example, the system 1000 includes the support structure 102 and the feedback assembly 106 of FIGS. 1A and 1B, and the feedback assembly 1006.

Figure 11:
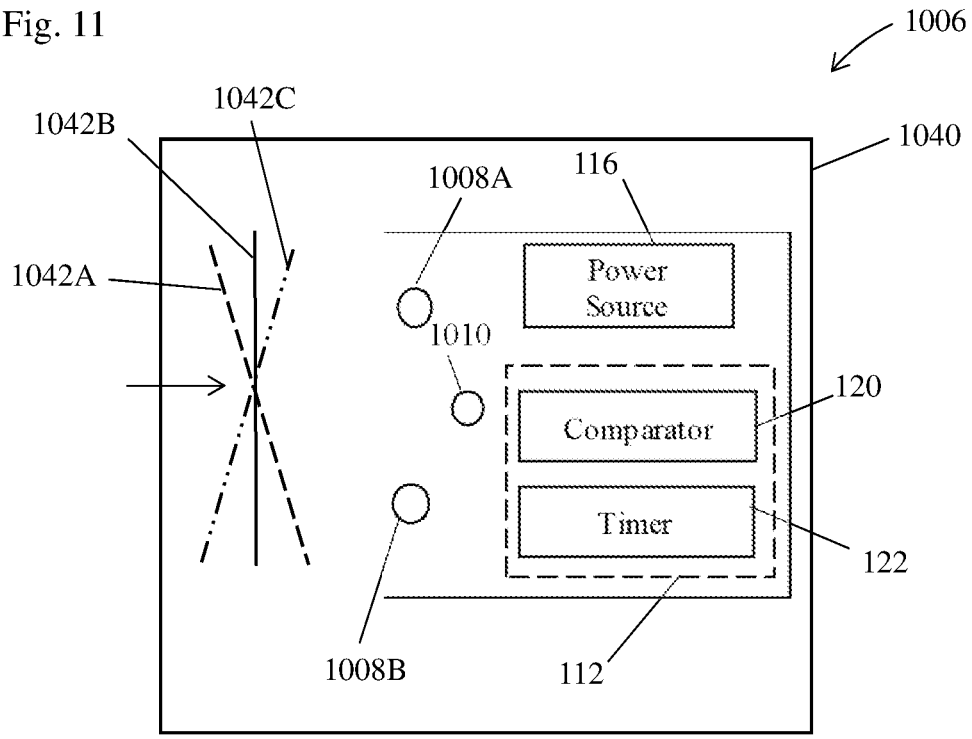
FIG. 11 is a block diagram of a feedback assembly employable in the training system of FIGS. 10A and 10B, according to another example embodiment.

As shown in FIG. 11, the feedback assembly 1006 includes the power source 116 and the control circuit 112 of FIGS. 1A and 1B, two sensors 1008A, 1008B, and a feedback indicator 1010. The sensors 1008A, 1008B are arranged in a defined pattern for sensing an emitted light beam from a light source 1070 as explained herein. For example, the light source may be attached to the golfer's glove so that the light source emits a light beam extending away from the butt of the club. In such examples, the light beam may extend substantially parallel with the club face. In some examples, the light beam may form a line segment such as one of the line segments 1042A, 1042B, 1042C shown in FIG. 11.

Figure 12:
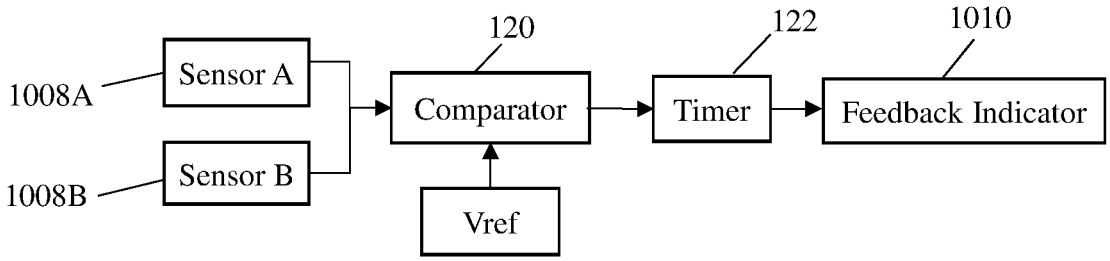
FIG. 12 is a control flow diagram for a control circuit of the feedback assembly of FIG. 11, according to yet another example embodiment.

In the example of FIGS. 10A, 10B and 11, the feedback indicator 1010 may provide an output in response to the sensors 1008A, 1008B sensing the line segment emitted from the light source at the same time. For example, and as shown in FIGS. 11 and 12, when the line segment 1042B travels across both sensors 1008A, 1008B, one or both sensors 1008A, 1008B may generate a signal. This signal is passed to the comparator 120 of the control circuit 112. The comparator 120 compares this signal with a reference signal Vref, and outputs a signal (e.g., a voltage signal) based on the comparison to the control circuit's timer 122, as shown in FIG. 12. The timer 122 activates after receiving the comparator's signal, and turns on the feedback indicator 1010, as explained herein. After a defined period of time, the control circuit 112 may turn off the feedback indicator 1010.

In some examples, the line segment may not travel across both sensors 1008A, 10088 at the same time. For example, the line segments 1042A, 1042C of FIG. 11 are oriented such that the line segments do not travel across both sensors 1008A, 10088 at the same time. In such examples, a signal would not be provided to the control circuit's comparator 120. These line segment orientations may indicate that the club is not parallel to the ground at the top of the backswing, the club face is not at the desired angle, etc.

As shown in FIG. 11, the feedback assembly 1006 may optionally include a phosphorescent sensor 1040. For example, the phosphorescent sensor 1040 may include a board positioned to track the emitted line segment from the light source. In such examples, the phosphorescent sensor 1040 may create a temporary visual representation of the path of the emitted line segment. In the example of FIG. 11, the control circuit 112, the sensors 1008A, 10088 and the feedback indicator 1010 form a module that is attached (e.g., detachably coupled, etc.) to the phosphorescent sensor 1040.

Figure 13:
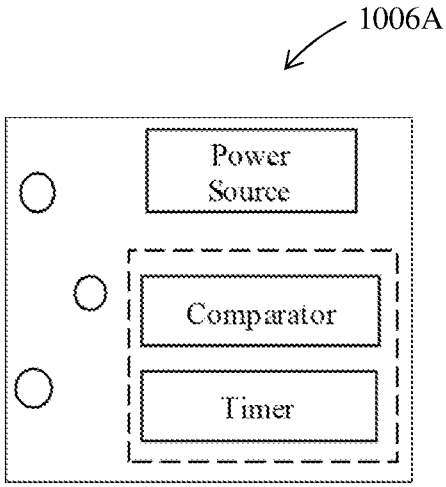
FIG. 13 is a block diagram of a feedback assembly including two sensors, a feedback indicator and control circuit according to another example embodiment.

In other examples, the feedback assembly may not include the phosphorescent sensor 1040. For example, FIG. 13 illustrates a feedback assembly 1006A that is the same as the feedback assembly 1006 but without a phosphorescent sensor. In some examples, the feedback assemblies 1006, 1006A may be used in a golf swing training system with or without another feedback assembly such as any one of the other feedback assemblies disclosed herein.

In some examples, the feedback assemblies 1006, 1006A may be used to provide user feedback in other swing related areas. For example, the sensors in the feedback assembly 1006A may be set apart from each other a defined distance, and the golfer may have a light source forming a line segment extending past the butt of the club as explained herein. As the butt of the club moves closer to the ground (e.g., a fixed point), the line segment becomes smaller. When the golfer swings, he/she may attempt to fit the line segment between the sensors on the feedback assembly 1006A without triggering the sensors if a short distance is beneficial. For example, during the downswing, it is beneficial to have the butt of the club pointing down to the ground and as close to the ground as possible. This is generally referred to as "lag." Additionally, during the take-away portion of the swing, it is desirable to have the club as far away from the body as possible when the club gets parallel to the ground. This is another example of where a short line segment may be desired. As such, the golfer may practice creating lag and desired take-away positions of his/her swing by trying to fit the line segment between the sensors on the feedback assemblies without triggering the sensors.

The feedback assemblies 1006, 1006A may be positioned in any suitable location. In the particular example of FIGS. 10A and 10B, the feedback assembly 1006 is detachably coupled to the support structure 102. Alternatively, the feedback assembly 1006 may be positioned on the ground, on another structure, etc. In some examples, the feedback assembly 1006 may be positioned on the ground between the golfer's feet. Likewise, the feedback assembly 1006A may be positioned on the ground, attached to the support structure 102, etc. Such placements of the feedback assemblies 1006, 1006A may indicate to the golfer that the club head is past the ball, the club is parallel to the ground at the top of the backswing, the club face is open or closed, etc.

Figure 14:
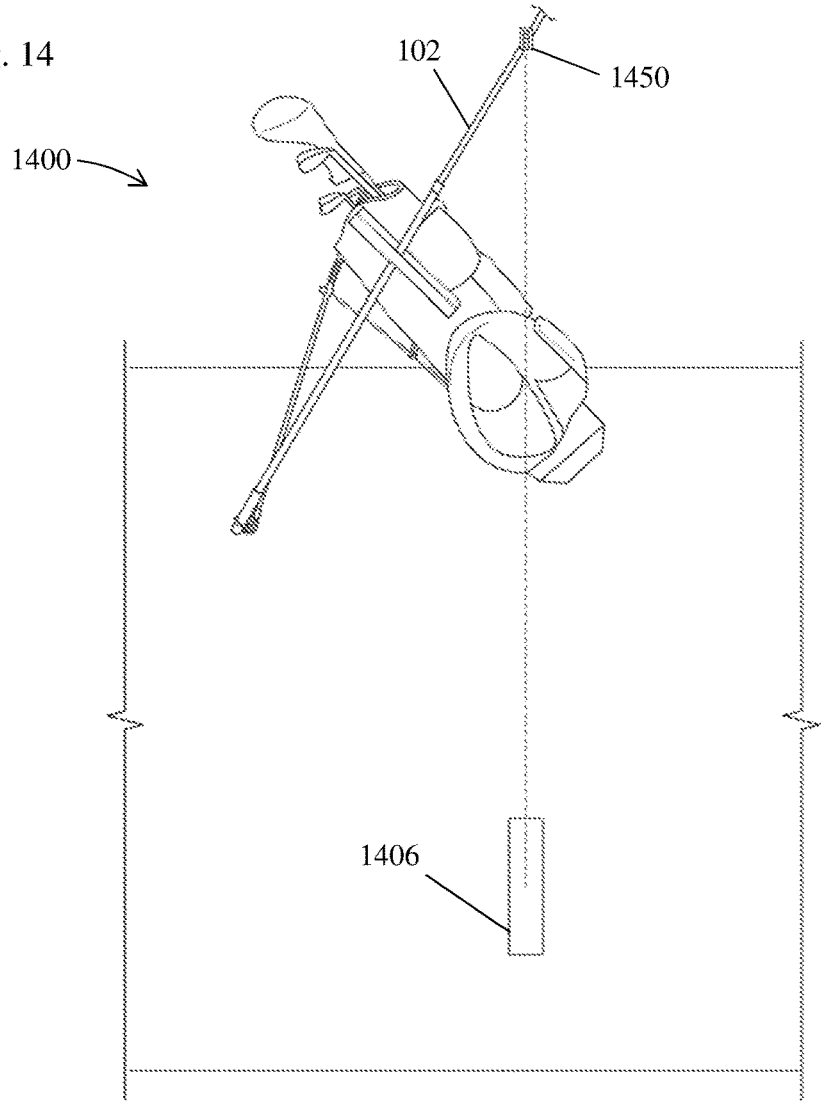
FIG. 14 is a front view of a golf swing training system including a feedback assembly for tracking a path of a golf club according to yet another example embodiment.

FIG. 14 illustrates a golf swing training system 1400 substantially similar to the other systems disclosed herein. The golf swing training system 1400 includes the support structure 102 of FIGS. 1A and 1B, a light source 1450 attached to the support structure 102, and a feedback assembly 1406 substantially similar to the other feedback assemblies disclosed herein. For example, and as shown in FIG. 15, the feedback assembly 1406 includes the power source 116 and the control circuit 112 of FIGS. 1A and 1B, a sensor 1408, and a feedback indicator 1410 configured to output an audible sound or light.

Figure 15:
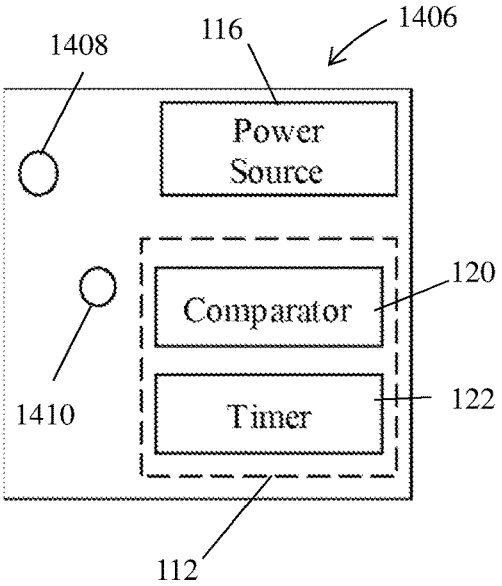
FIG. 15 is a block diagram of a feedback assembly employable in the training system of FIG. 14, according to another example embodiment.

In the example of FIGS. 14 and 15, the control circuit 112 receives a signal from the sensor 1408, and turns on the feedback indicator 1410 to provide an output in response to receiving the signal. This may indicate the golf club is in a desired path during the golfer's downswing. For example, the sensor 1408 may be positioned in a defined location on the ground in a desired path of the golf club to allow the sensor 1408 to sense a light beam emitted from the light source 1450. In such examples, the sensor 1408 may be positioned between the golfer's feet and a golf ball when the golfer sets up in an address position, or another suitable location.

In a static condition, the emitted light beam is pointed at the sensor 1408. During the golfer's swing, the club may travel in a desired path and pass through the light beam. For example, the desired path of the club may be to have the downswing of the club to go below the swing plane to create a draw spin on the ball. In such examples, the sensor 1408 may detect the interruption of the light beam, and generate a signal. The comparator 120 in the control circuit 112 may compare this signal with a reference signal, and output a signal to the timer 122 in the control circuit 112 as explained above. The timer 122 may then activate, and power the feedback indicator 1410 for a defined period of time. As such, the golfer may be notified when his/her club travels in a desired path and breaks the light beam during the golfer's swing (e.g., downswing or backswing). Alternatively, when the club travels outside a desired path, the club does not pass through the light beam. In such examples, the feedback indicator 1410 would not activate. By utilizing multiple light beams and sensors, the precise location the club traveled can be determined. This configuration could also be employed in other parts of the golf swing such as past the ball to detect the path and height of the club during the follow through, etc.

Any one of the feedback assemblies disclosed herein may be employed in a golf swing training system. For example, FIG. 16 illustrates a golf swing training system 1600 including the feedback assembly 106 of FIGS. 1 and 2, the feedback assembly 806 of FIGS. 8 and 9, the feedback assembly 1006 of FIGS. 10A, 10B and 11, and the feedback assembly 1006A of FIG. 13.

Figure 16:
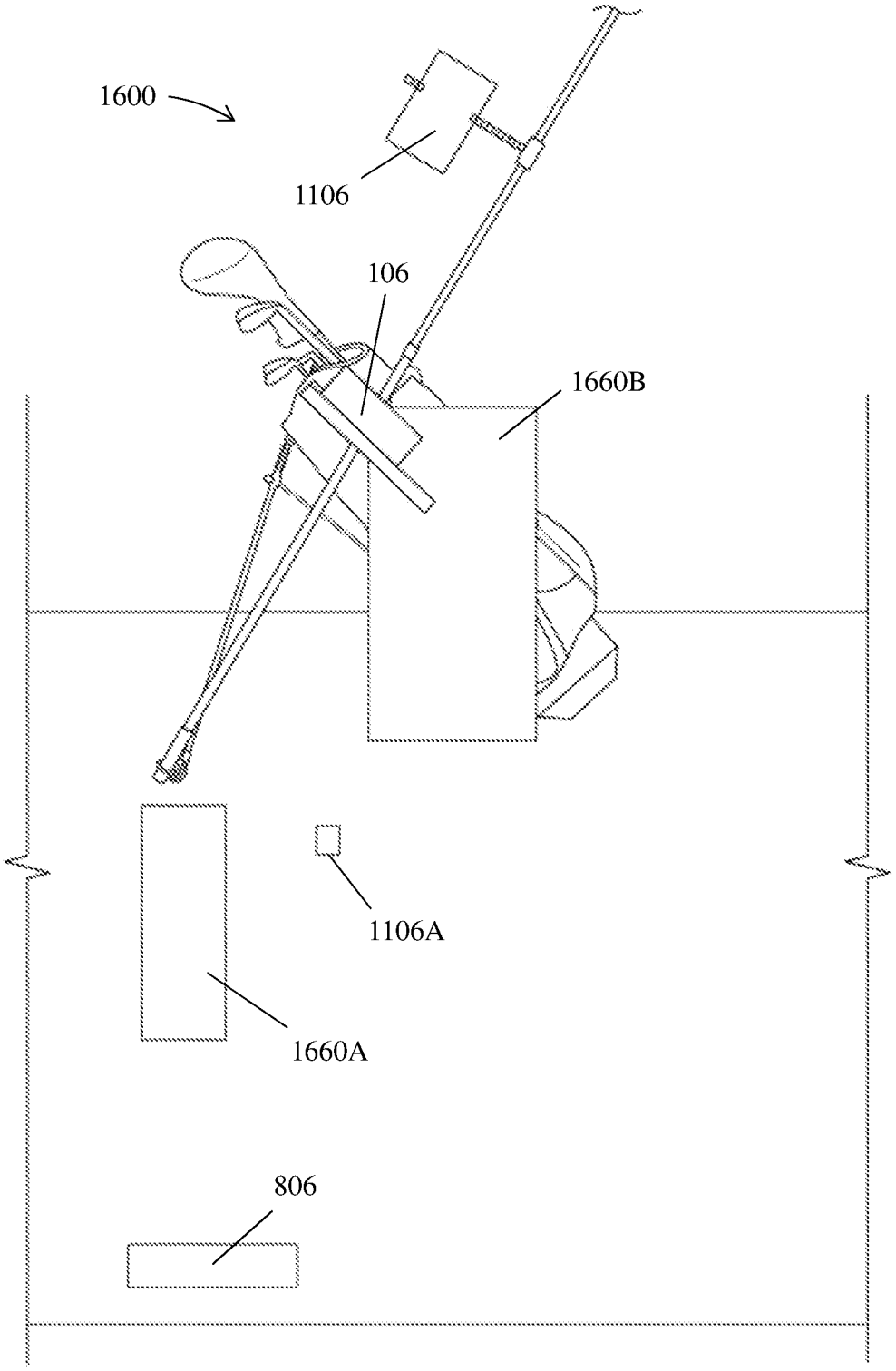
FIG. 16 is a front view of a golf swing training system including multiple feedback assemblies for tracking a path of a golf club according to yet another example embodiment.

Additionally, and as shown in FIG. 16, the system 1600 may optionally include one or more phosphorescent sensors for tracking and providing visual feedback of the golfer's swing. For example, in the particular example of FIG. 16, the system 1600 includes a phosphorescent sensor (e.g., a board) 1660A positioned on the ground and another phosphorescent sensor (e.g., a board) 1660B positioned adjacent the feedback assembly 106. In other examples, more, less and/or different phosphorescent sensors, feedback assemblies, etc. may be employed. For example, a phosphorescent sensor may be positioned across from the phosphorescent sensor 1660B of FIG. 16 (e.g., on the opposing side of the golfer) to detect the path of the club during a follow through portion of the golfer's swing.

Figure 17:
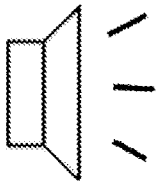
FIG. 17 is a block diagram of a speaker employable as a feedback indicator according to another example embodiment.
Figure 18:
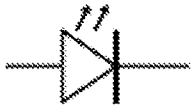
FIG. 18 is a block diagram of a light emitting diode (LED) employable as a feedback indicator according to yet another example embodiment.

The feedback indicators disclosed herein may be any suitable device that, when activated, effectively attracts the attention of the golfer. For example, any one of the feedback indicators may include a device such as a speaker (see FIG. 17) that outputs an audible sound and/or a light source such as an LED (see FIG. 18) that outputs light. The output of each feedback indicator may be continuous (until the indicator is deactivated), or repeating (e.g., periodically or randomly activated). In some examples, the output may be different for different conditions. For example, the speaker may provide one audible sound having a noise (dB) level and/or pitch for one condition (e.g., one sensor triggered), and another audible sound having a different noise (dB) level and/or pitch for another condition (e.g., another sensor triggered).

Figure 19:
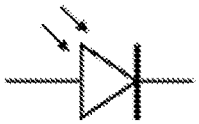
FIG. 19 is a block diagram of a photodiode employable as a sensor according to another example embodiment.

The sensors disclosed herein may be any suitable device that detects a light beam. For example, any one of the sensors may include a photodiode (see FIG. 19) that generates current when hit by a light beam. In such examples, the generated current may pass through a resistor electrically coupled to the photodiode, and a voltage across the resistor may be used as a signal for comparing to a reference signal. In some examples, the light beam and the photodiode sensing the light beam may be the same color, or different colors. Additionally, a set of sensors employed in the same feedback assembly may be positioned side-by-side (as shown in FIG. 2), or spaced apart.

The reference signals disclosed herein may be reference voltages or other suitable signals. In some examples, any one of the reference signals may be generated with a photodiode sensing ambient light. In other examples, the reference signal may be generated in another suitable manner such as, for example, by a power source (e.g., a battery, etc.). The reference signals may be fixed or variable.

The light sources disclosed herein may be any suitable source of light. For example, any one of the light sources may be a laser emitting a laser beam. The laser beam may form a single dot, a line segment, etc. as explained herein. For example, the laser may include a lens that forms the line segment.

The light sources may be positioned in various locations in the systems. In some examples, one or more light sources may be attached to the golfer. For example, FIGS. 1A, 1B, 10A and 10B illustrate light sources 170, 1070 detachably coupled to gloves worn by the golfer. Alternatively, the light source(s) may be attached to the support structure 102 as explained herein.

Figure 20:
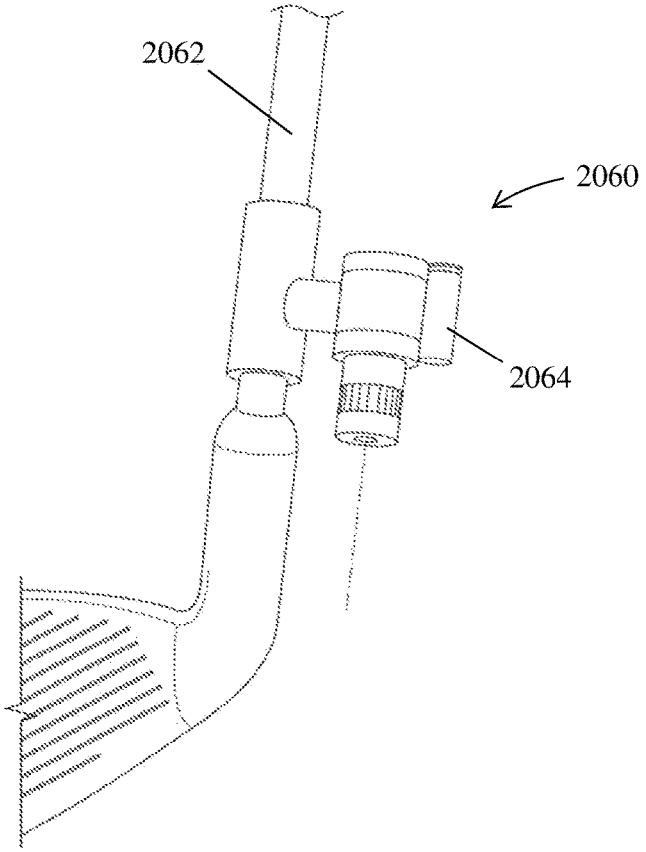
FIG. 20 is a front view of a golf club including a light source according to yet another example embodiment.

In other examples, the light source(s) may be attached to a golf club. For example, FIG. 20 illustrates a light source 2060 detachably coupled to a club 2062. In the example of FIG. 20, the light source 2060 includes a laser and a power source 2064 (e.g., a battery) for powering the laser. The light source 2060 may be positioned along the club at any suitable location including, for example, adjacent the club's hosel and/or ferrule as shown in FIG. 20.

The light sources disclosed herein may be turned on/off in any suitable manner. For example, any one of the light sources may be turned on/off by controlling a switch. Alternatively, the light source may be turned on/off via an air gap. For example, when a light source is attached to the club, the light source may include an air gap between its power source and laser. When sufficient force is applied (e.g., due to the golfer swinging the club), the air gap may be eliminated such that the power source and the laser is electrically connected.

The support structures disclosed herein may be any suitable structure extending at least partially in a longitudinal direction. In some examples, the support structures may include a longitudinal extending portion and a curved portion. Any one of the support structures may include an elongated rod-like shape such as a golf ball retriever as shown in FIGS. 1A and 1B. The support structure may have a round, a square, a rectangular, a triangular, etc. cross-sectional shape.

In some examples, any one of the support structures may be an adjustable structure. In such examples, the support structure may be rotatable about an axis and/or extendable in a longitudinal direction to allow the golfer to alter the location of a feedback assembly attached to the structure for different clubs, different golfers, etc. For example, and as shown in FIG. 1A, the support structure 102 includes an end detachably coupled to a leg of the golf bag 114 via magnets and a midsection detachably coupled to a side of the golf bag 114 via magnets and a U-shaped bracket. This arrangement allows the support structure 102 to rotate about its end coupled to the leg of the golf bag 114 while the midsection slides along a leg of the U-shaped bracket. Additionally and/or alternatively, the support structure 102 (e.g., an extendable golf ball retriever) may be extendable in a longitudinal direction if needed.

The control circuit features disclosed herein may be implemented in one or more hardware components and/or software. For example, any one of the control circuits disclosed herein may include necessary hardware and/or software components for comparing different signals, turning on/off a feedback indicator, etc. The control circuits may include an analog control circuit, a digital control circuit (e.g., a digital signal controller (DSC), a digital signal processor (DSP), etc.), or a hybrid control circuit (e.g., a digital control circuit and an analog control circuit).

In some examples, the control circuits may include additional components not shown in the figures. For example, any one of the control circuits may include one or more comparators, timers, resistors, capacitors, etc. In such examples, one or more of the resistors and capacitors may form RC networks for setting an activation time for a feedback indicator, a frequency of the audible sound or light provided by a feedback indicator, etc.

Additionally, control circuits from different feedback assemblies may be integrated into one control circuit. For example, in the system 800 of FIG. 8, the control circuits 412 of the feedback assembly 806 and the control circuit 112 of the feedback assembly 106 may be integrated and placed on one printed circuit board (PCB). In other examples, the control circuits 112, 412 may be physically and electrically separated (e.g., isolated, etc.) from each other as shown in FIG. 8. This may provide for a more flexible, interchangeable, separable, etc. system.

Although the systems disclosed herein are setup for a right-handed golfer, it should be apparent to those skilled in the art that the systems may be setup for a left-handed golfer. In such cases, the support structure would extend in an opposite direction. For example, the support structure for a left-handed golfer may extend from the base of the golf bag and past the clubs stored in the golf bag.

The golf swing training systems disclosed herein may be mobile systems. For example, the golfer may assemble and disassemble any one of the systems with ease. As such, the golfer may use the system at the range, at home, on the course, etc. Additionally, the golf swing training systems are modifiable such that one or more components (e.g., feedback assemblies, etc.) may be moved, added, and/or removed. For example, any one of the feedback assemblies may be moved to multiple locations to allow the golfer to gain feedback on the path of the club, the face angle of the club, etc. for different clubs, swings, etc. This allows the golfer to practice the swing locations, face angles, etc. and learn how to create straight, draw and fade shots.

Additionally, by employing any one of the golf swing training systems disclosed herein, the golfer may be able to receive feedback on whether his/her club is parallel to the ground at the top of the backswing, where his/her club is perpendicular to the ground during the swing, the location of the club at the top of the backswing, whether the club head is past the ball, etc. As such, the golf swing training systems may teach the golfer a proper and consistent swing for all of his/her clubs by providing specific feedback such as visual feedback, audible feedback, etc. before and during each part of the golfers' swing.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A golf swing training system for tracking a path of a golf club when a golfer swings the golf club, the golf swing training system comprising:

a support structure positionable to a side of a golfer when the golfer sets up in an address position;

a light source configured to attach to the golfer or the golf club, and emit a light beam that follows the path of the golf club when the golfer swings the golf club;

a plurality of sensors configured to attach to the support structure in a defined pattern for sensing the emitted light beam from the light source;

one or more feedback indicators configured to attach to the support structure for indicating the path of the golf club, each feedback indicator associated with at least one of the sensors; and a control circuit in communication with the feedback indicators and the plurality of sensors, the control circuit configured to receive a signal from a sensor of the plurality of sensors in response to the sensor sensing the emitted light beam from the light source, and in response to receiving the signal, turn on one of the feedback indicators associated with the sensor to indicate the path of the golf club.

2. The golf swing training system of claim 1 wherein the support structure includes a rod rotatable about an axis and/or extendable in a longitudinal direction.

3. The golf swing training system of claim 1 wherein the light source is a laser.

4. The golf swing training system of claim 1 wherein each of the sensors includes a light emitting diode (LED) configured to generate a signal in response to the emitted light beam being applied to the LED.

5. The golf swing training system of claim 1 wherein the sensors include at least a first set of sensors and a second set of sensors, and wherein one of the feedback indicators is associated with the first set of sensors and another one of the feedback indicators is associated with the second set of sensors.

6. The golf swing training system of claim 1 wherein the control circuit is configured to turn off said one of the feedback indicators after a defined period of time.

7. The golf swing training system of claim 6 wherein said one of the feedback indicators is turned on to indicate the path of the golf club during the golfer's backswing, and wherein the control circuit is configured to receive another signal generated by one of the sensors in response to that sensor sensing the emitted light beam from the light source during the golfer's downswing, and turn on another one of the feedback indicators to indicate the path of the golf club during the golfer's downswing.

8. The golf swing training system of claim 7 wherein the control circuit is configured to turn off the other one of the feedback indicators after a defined period of time.

9. The golf swing training system of claim 1 further comprising another light source configured to attach to the golfer or the golf club, and emit a light beam forming a line segment.

10. The golf swing training system of claim 9 further comprising a phosphorescent sensor positioned to track the emitted line segment from the other light source.

11. The golf swing training system of claim 9 wherein the plurality of sensors are first sensors and the feedback indicators are first feedback indicators, the golf swing training system further comprising a feedback assembly including two second sensors positionable in a defined pattern for sensing the line segment emitted from the other light source, and a second feedback indicator configured to output an audible sound or light in response to the two second sensors sensing the line segment emitted from the other light source at the same time.

12. The golf swing training system of claim 1 wherein the plurality of sensors are first sensors and the feedback indicators are first feedback indicators, the golf swing training system further comprising a feedback assembly including one or more second sensors configured to sense the emitted light beam from the light source, and a second feedback indicator configured to output an audible sound or light in response to the one or more second sensors sensing the emitted light beam.

13. A golf swing training system for tracking a golf club and/or an angle of a club face of the golf club when a golfer swings the golf club, the golf swing training system comprising:

a light source configured to attach to the golfer or the golf club, and emit a light beam forming a line segment that follows a path of the golf club when the golfer swings the golf club;

two sensors positionable in a defined pattern for sensing the line segment emitted from the light source, the two sensors configured to generate a signal in response to the two sensors sensing the line segment emitted from the light source at the same time;

a feedback indicator configured to output an audible sound or light; and a control circuit in communication with the feedback indicator and the two sensors, the control circuit configured to receive the signal from the sensors, and turn on the feedback indicator to output the audible sound or light in response to receiving the signal.

14. The golf swing training system of claim 13 wherein the control circuit is configured to turn off the feedback indicator after a defined period of time.

15. The golf swing training system of claim 13 wherein the two sensors includes two light emitting diodes (LEDs) configured to generate the signal in response to the line segment emitted from the light source being applied to the LEDs.

16. The golf swing training system of claim 13 further comprising a support structure positioned to a side of a golfer when the golfer sets up in an address position, wherein the two sensors are configured to attach to the support structure.

17. The golf swing training system of claim 13 wherein the two sensors are positionable on the ground.

18. A golf swing training system for tracking a path of a golf club during a golfer's downswing, the golf swing training system comprising:

a support structure positionable to a side of a golfer when the golfer sets up in an address position;

a light source configured to attach to the support structure and emit a light beam;

a sensor positionable in a defined location on the ground in a desired path of the golf club, the sensor configured to sense the light beam emitted from the light source and generate a signal when the light beam emitted from the light source is broken due to the golfer's downswing;

a feedback indicator configured to output an audible sound or light; and a control circuit in communication with the feedback indicator and the sensor, the control circuit configured to receive the signal from the sensor, and turn on the feedback indicator to output the audible sound or light in response to receiving the signal to indicate the golf club is in the desired path during the golfer's downswing.

19. The golf swing training system of claim 18 wherein the control circuit is configured to turn off the feedback indicator after a defined period of time.

20. The golf swing training system of claim 18 wherein the sensor includes a light emitting diode (LED) configured to generate the signal when the light beam emitted from the light source is broken due to the golfer's downswing.

* * * * *